US007228747B2

(12) United States Patent
Pieper

(10) Patent No.: US 7,228,747 B2
(45) Date of Patent: Jun. 12, 2007

(54) DEVICE FOR DETECTING RAIL MOVEMENT

(76) Inventor: Siegfried Pieper, Pfeddersheimer Strasse 95, 67549 Worms (DE)

( * ) Notice: Subject to any disclaimer, the term of this patent is extended or adjusted under 35 U.S.C. 154(b) by 0 days.

(21) Appl. No.: 10/494,003

(22) PCT Filed: Oct. 17, 2002

(86) PCT No.: PCT/EP02/11596

§ 371 (c)(1),
(2), (4) Date: Nov. 4, 2004

(87) PCT Pub. No.: WO03/037695

PCT Pub. Date: May 8, 2003

(65) Prior Publication Data

US 2005/0066743 A1 Mar. 31, 2005

(30) Foreign Application Priority Data

Oct. 28, 2001 (DE) ..... 101 52 380

(51) Int. Cl.
*G01N 3/02* (2006.01)

(52) U.S. Cl. ..... 73/856

(58) Field of Classification Search ..... 73/856
See application file for complete search history.

(56) References Cited

U.S. PATENT DOCUMENTS 3,581,084 A * 5/1971 Kaneno et al. ..... 246/249
4,103,547 A * 8/1978 Vrabel ..... 73/146
4,181,430 A * 1/1980 Shirota et al. ..... 356/3.06
4,526,039 A * 7/1985 Ceccon et al. ..... 73/774
4,744,302 A * 5/1988 Theurer et al. ..... 104/7.2
4,783,001 A * 11/1988 Subrick ..... 238/53
4,804,270 A * 2/1989 Miller et al. ..... 356/508
5,161,891 A * 11/1992 Austill ..... 374/141
5,189,492 A 2/1993 Sollinger et al. ..... 356/373
5,346,131 A * 9/1994 Meier et al. ..... 238/283
5,656,783 A 8/1997 Frisch et al. ..... 73/800
5,660,470 A 8/1997 Mench ..... 374/121
6,119,353 A * 9/2000 Grønskov ..... 33/1 Q
6,634,112 B2 * 10/2003 Carr et al. ..... 33/287
6,674,023 B2 * 1/2004 Paine ..... 177/132
6,817,246 B1 * 11/2004 Rottner et al. ..... 73/573

FOREIGN PATENT DOCUMENTS

DE 2043436 3/1972

(Continued)

*Primary Examiner*—Max Noori
(74) *Attorney, Agent, or Firm*—Darby & Darby

(57) ABSTRACT

A device for holding a transmitter and a receiver for detecting a deformation state of a component. The device includes a first holding part and a first receptacle, the transmitter being disposed on the first holding part via the first receptacle, wherein the first receptacle and the first holding part, together with the component, form at least one of a first connecting element, a first clamp, a first positive fit joint, a first glued joint, and a first welded joint. The device also includes a second holding part and a second receptacle, the receiver being disposed on the second holding part using the via receptacle, wherein the second receptacle and the second holding part, together with the component, form at least one of a second connecting element, a second clamp, a second positive fit joint, a second glued joint, and a second welded joint.

15 Claims, 9 Drawing Sheets

FOREIGN PATENT DOCUMENTS

| | | |
|---|---|---|
| DE | 32 09 582 | 9/1983 |
| DE | 33 09 908 | 11/1983 |
| DE | 8601185 | 8/1986 |
| DE | 35 37 420 | 4/1987 |
| DE | 43 32 807 | 4/1994 |
| DE | 44 39 342 | 5/1996 |
| DE | 44 46 760 | 6/1996 |
| EP | 00 67 531 | 12/1982 |
| EP | 02 11 627 | 2/1987 |
| EP | 0352464 | 1/1990 |
| EP | 0619401 | 10/1994 |
| WO | WO 01/18487 A1 * | 3/2001 |

* cited by examiner

Fig. 9a1

Fig. 9a2

Figure 1A:
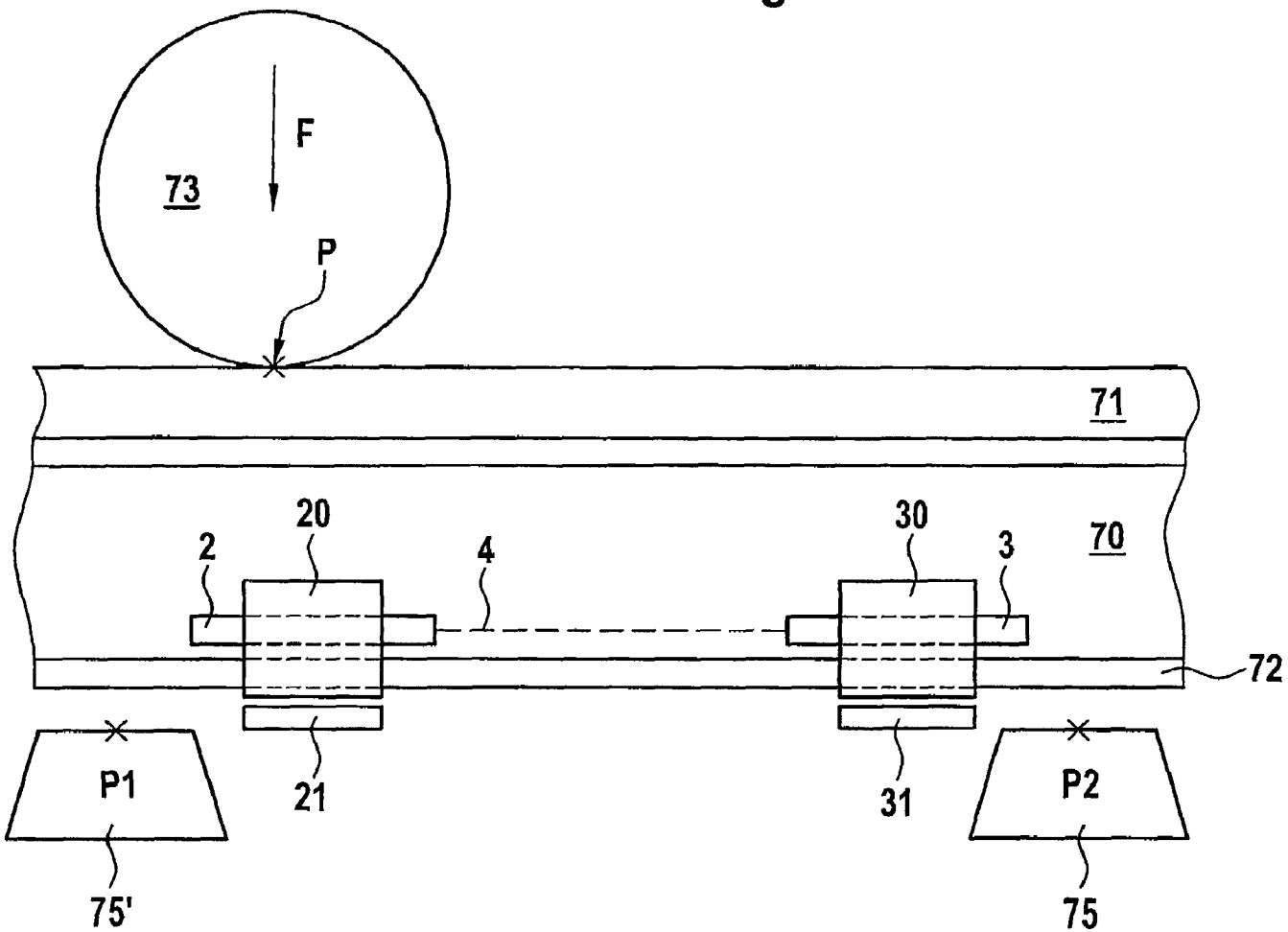
Figure 1B:
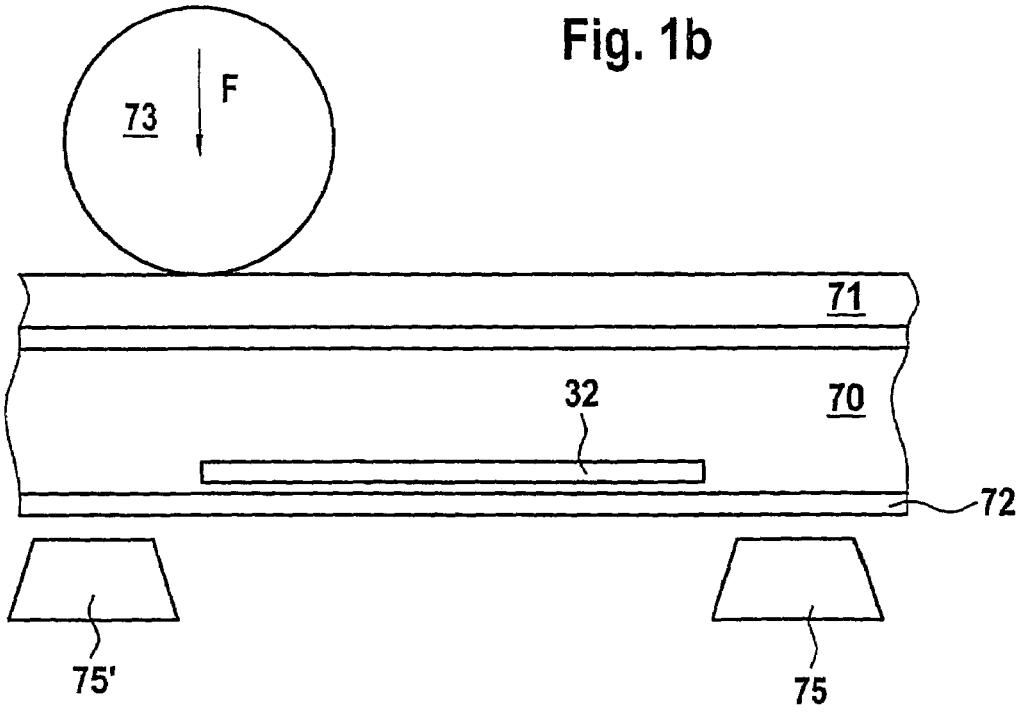
Figure 1C:
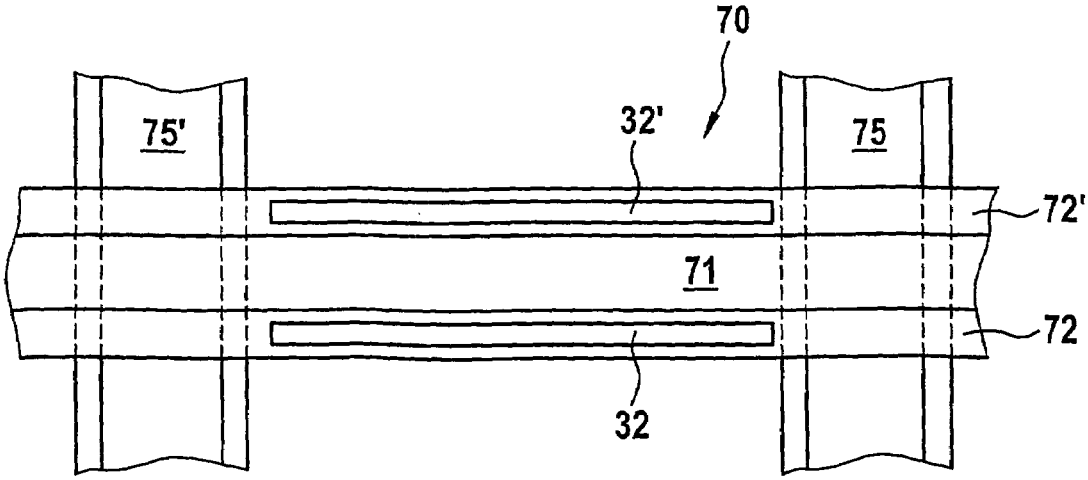
Figure 2:
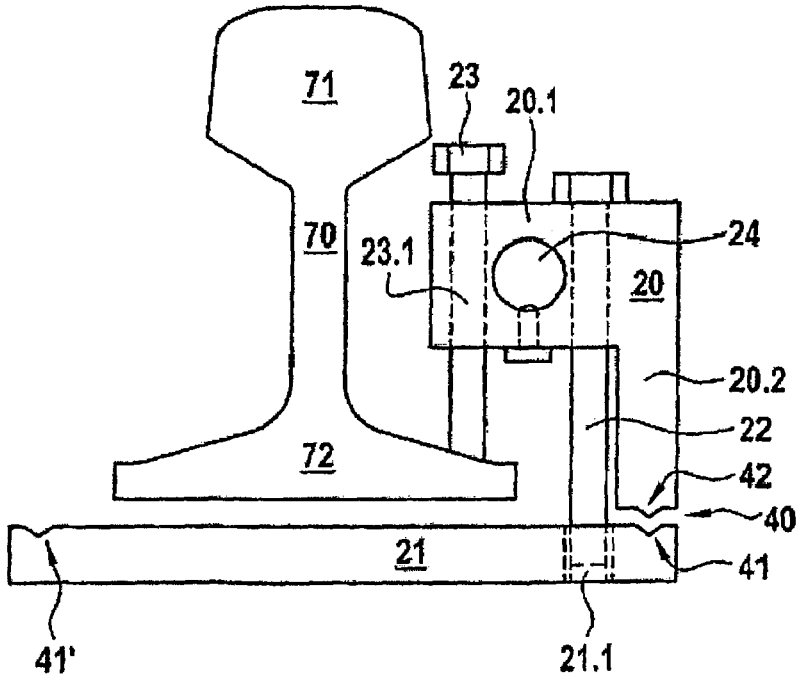

Fig. 9b1
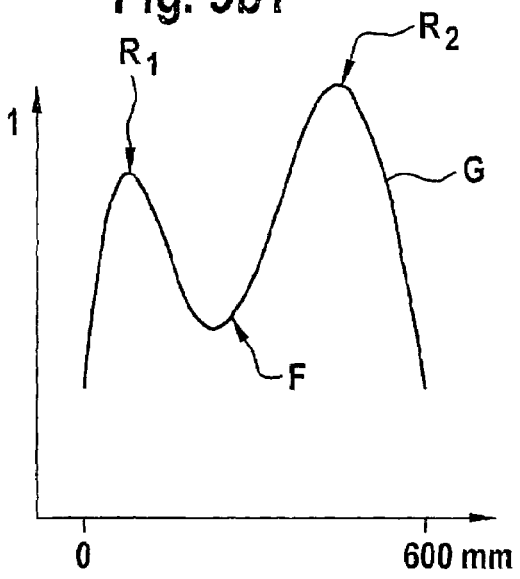
Fig. 9b2
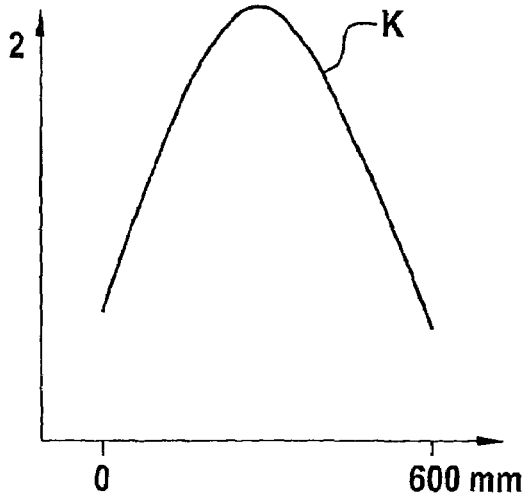
Fig. 9c1
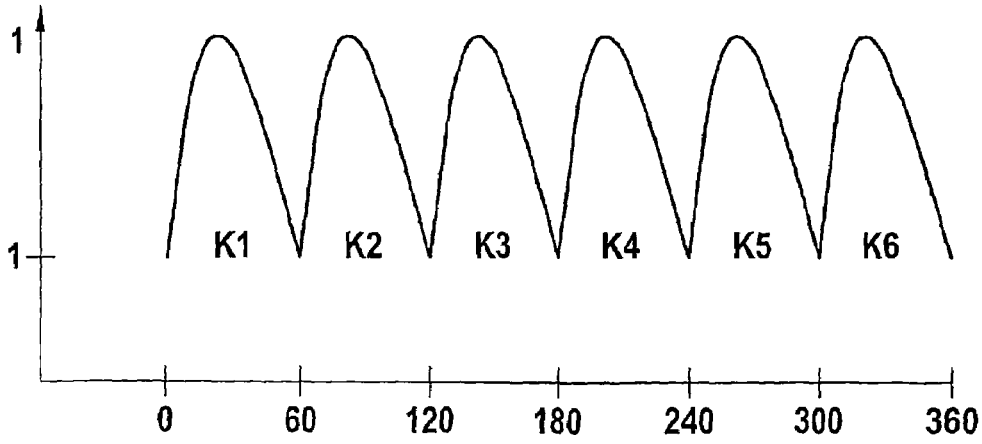
Fig. 9c2
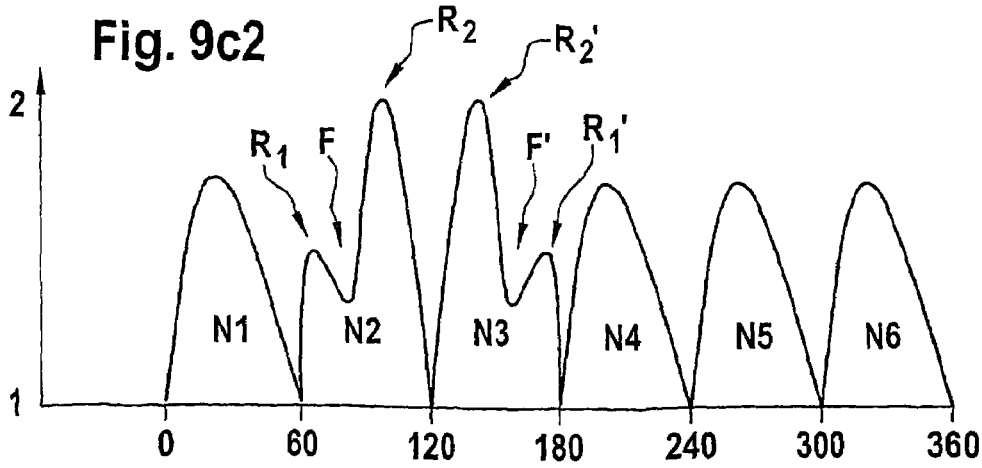

DEVICE FOR DETECTING RAIL MOVEMENT

CROSS-REFERENCE TO RELATED APPLICATIONS

This application is a U.S. National Stage Application under 35 U.S.C. §371 of PCT International Application No. PCT/EP02/11596, filed Oct. 17, 2002, which claims priority to German Patent Application DE 101 52 380.7, filed Oct. 28, 2001. Each of these applications is incorporated herein by reference as if set forth in its entirety.

The invention relates to a device for a transmitter and for a receiver for detecting various deformation states of a component that, independently of each other, are arranged on the component at a distance from each other by means of a receptacle.

A deformation sensor is already known from international application WO 01/18487 A1 in which a transmitter and a receiver for measuring deformation states are arranged together on a plate. Here, the plate is attached to a component by means of at least one clamping element, whereby the clamping element has two pointed or round contact parts and at least one bore corresponding to the plate.

An object of the invention is to provide for configuring and arranging a holding device for a transmitter-receiver unit in such a way that simple and precise assembly is ensured.

The present invention provides a device for a transmitter (2) and a receiver (3) for detecting various deformation states of a component (1) that, independently of each other, are arranged on the component (1) at a distance from each other by means of a receptacle (20, 30). The transmitter is arranged on a first holding part by means of a first receptacle and the receiver is arranged on a second holding part by means of a second receptacle, whereby, together with the component, each receptacle and each holding part form one or more connecting elements or one or more clamped and positive-fit joints or a glued joint or a welded joint. In this manner, the transmitter and the receiver are arranged on the component independently of each other, whereby the receptacle serves simultaneously as part of the clamped joint for the transmitter and the receiver. By integrating the receptacle into the clamping device, during the clamping procedure, the receptacle is deformed, thus causing an adjustment of the transmitter or the receiver. The independence of the transmitter and receiver receptacle or holding part ensures that the component absorbs the deformation in a manner that is free of influences. Neither the transmitter nor the receiver absorb a force that is generated by the deformation of the component.

For this purpose, it is also advantageous for the receptacle and the holding part to have a corresponding fit, whereby this fit is configured as a groove-and-tongue joint and/or as a location pin. Thanks to the fit, the assembly effort or the adjustment effort of the receptacle on the holding part is reduced to a minimum.

Moreover, it is advantageous for the receptacle to be configured as a lug and to be connected to the holding part by means of a pin joint and/or a bolted joint, whereby the receptacle and/or the holding part has a clamping element that is configured as a bolt, a screw and/or a cam and that interacts with the component. Through the use of an additional clamping element, the receptacle can be attached to the holding part independently of the clamped joint. By means of the independent clamping element, the receptacle can be moved together with the holding part relative to the component, without the connection between the receptacle and the holding part having to be severed.

It is of special significance for the present invention for the receptacle to have a holding element for the transmitter and/or the receiver, whereby the holding element is configured as a bore and has a fastening element configured as a cap nut for the transmitter and/or the receiver. The configuration as a precision bore ensures an optimal protection for the transmitter or the receiver which, if the bore is sufficiently long, can be inserted into the bore and sunk there.

It is also advantageous for the first receptacle for the transmitter and the second receptacle for the receiver to have at least one corresponding adjustment surface that can be joined using an assembly device, whereby the adjustment surface is configured as a groove, a bore and/or a bevel and the assembly device has adjustment elements such as a tongue or a pin that correspond to the adjustment surface. In this manner, a transmitter receptacle and a receiver receptacle can be aligned relative to each other in a simple manner. The assembly device can be used for any receptacles and does not have to stay on the device.

Moreover, it is advantageous for there to be several receptacles within a measuring area of the component, whereby the receivers are in operative connection via an evaluation unit.

An additional possibility according to another embodiment is for there to be several transmitter-receiver pairs arranged on opposite sides of the component. When the device is used for measuring rail systems, the transmitter and the receiver are positioned on opposite sides of the rail, that is to say, on the right-hand and left-hand sides of the rail relative to the longitudinal axis of the rail, and they extend along a rail section between 3 m and 30 m that is to be measured.

Finally, it is advantageous for a measuring current generated by the receiver to be transformed into a measuring voltage inside the evaluation unit, and the angular change between the transmitter and the receiver upon which the voltage change is based is determined according to the following formula:

$$\frac{U_1 - U_2}{U_1 + U_2} = \Delta\alpha_1$$

In this context, it is advantageous for the load forces $F_Q$, $F_Y$ upon which the deformation of the component is based to be determined at a right angle to the longitudinal direction of the component according to the following formula:

$$F_Q = \frac{\Delta\alpha_1 + \Delta\alpha_2}{2}$$

$$F_Y = \frac{\Delta\alpha_1 - \Delta\alpha_2}{\Delta\alpha_1 + \Delta\alpha_2}$$

wherein $F_Q$ stands for the force in the direction of the vertical and $F_Y$ stands for the force running at a right angle thereto, and $\alpha_1$, $\alpha_2$ stand for the angular change of at least two different transmitter-receiver pairs that are arranged on one side of and/or opposite to the component relative to the Y-direction.

For this purpose, it is also advantageous for the deformation $\Delta X$ of the component to be proportional to the detected angular change $\Delta\alpha$ and for it to be detected as a function of the component length L, whereby the surface area of a deformation graph "X over L" determined in this manner is normalized through a mean value formation ΔX' of all of the deformation graphs upon which one load cycle is based, and the ratio of the deformation ΔX to the normalized deformation ΔX' is calculated. For the normalization, all of the deformation graphs corresponding to a normal load are averaged. The graphs diverging from a normal deformation are not taken into account since these distort the overall result of the mean load graph. Thus, all variables such as temperature, rail bed condition, material condition and basic load of the component are eliminated so as to ensure that the deformation of the component is represented so as to correspond to the basic load.

Finally, it is advantageous for the connecting element to consist of the holding part that can be placed underneath the rail foot and of a receiving part arranged thereupon so as to be height-adjustable and made up of two legs, whereby at least two screws can be screwed into the one leg, whereby the one screw can be placed against the component or the rail foot, and the other screw part creates a fixed connection between the holding part and the component or the rail, whereby the second leg can be pressed against the holding part by means of at least one screw.

Additional advantages and details of the invention are explained in the patent claims and in the description and they are depicted in the figures. The following is shown:

FIG. 1*a* a schematic representation of a rail with a transmitter and a receiver;

FIG. 1*b* a schematic representation of the rail with a transmitter-receiver unit;

FIG. 1*c* a schematic representation of two transmission units arranged opposite to each other relative to a longitudinal direction of the rail.

Figure 3:
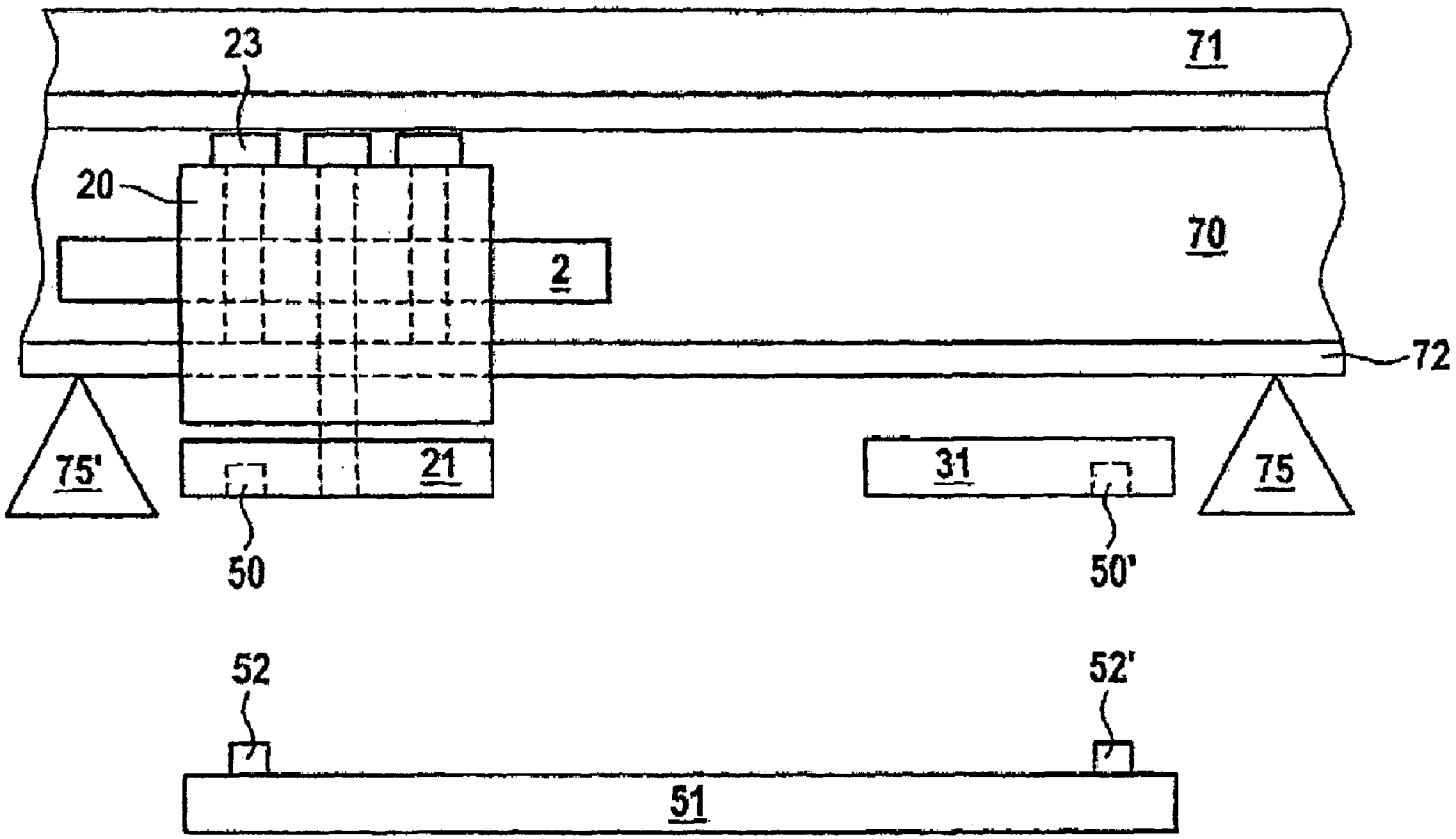
Figure 4A:
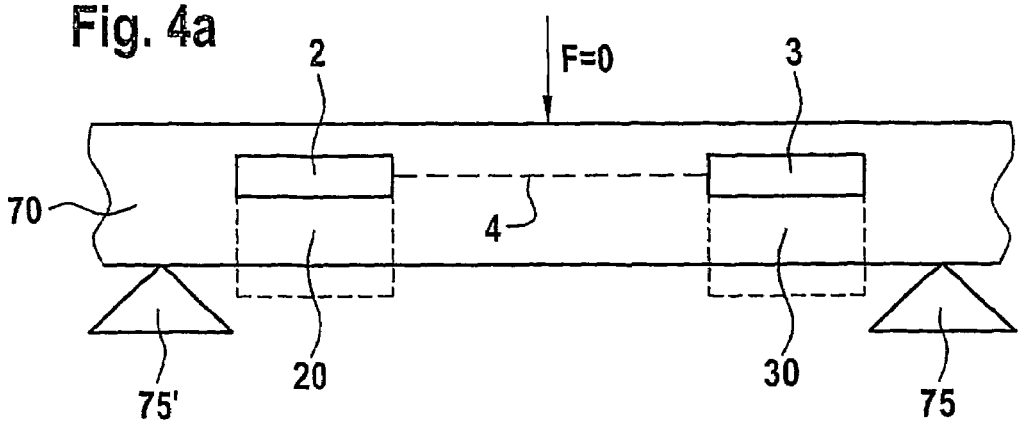
Figure 4B:
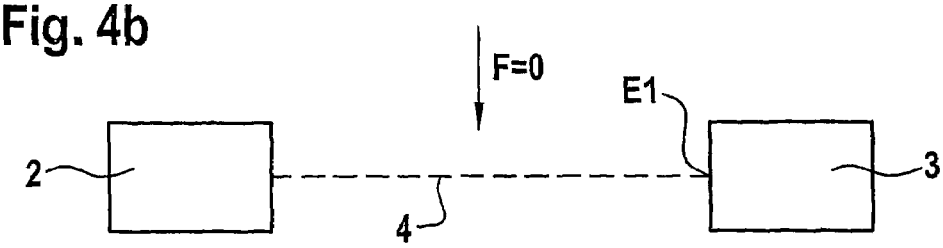
Figure 4C:
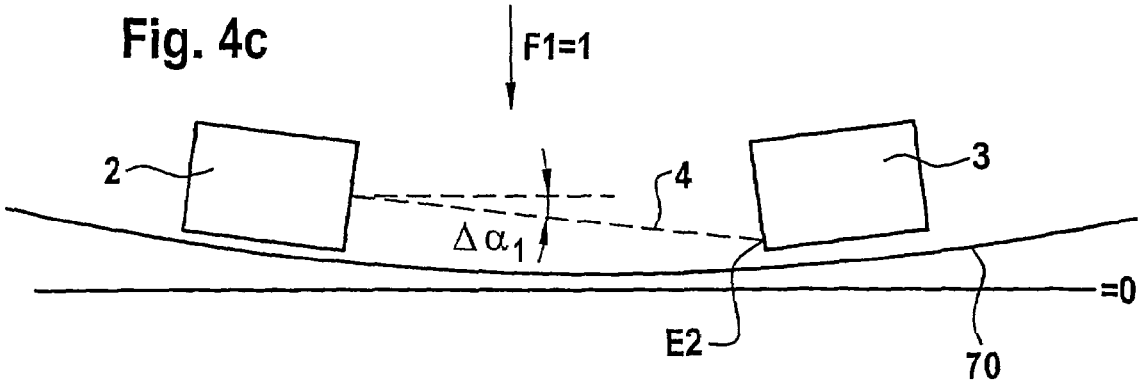
Figure 4D:
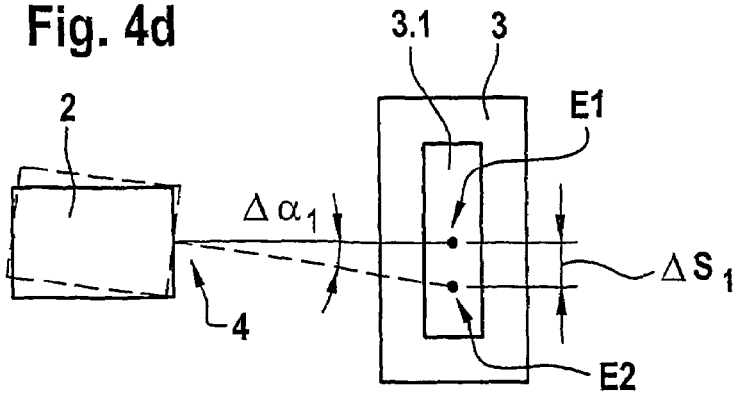
Figure 5:
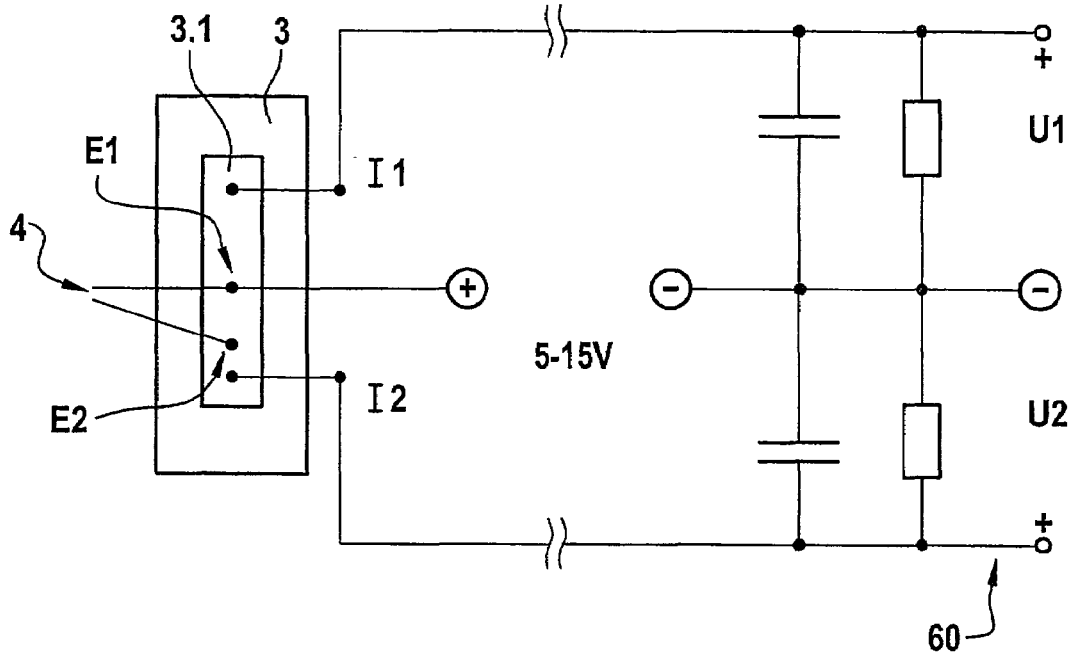
Figure 6:
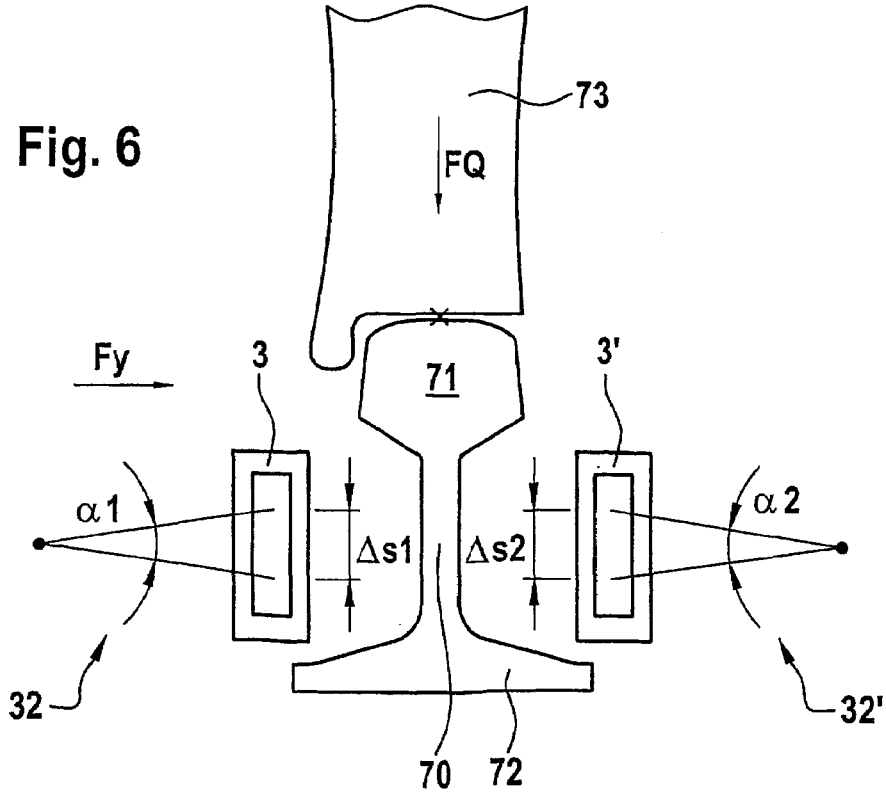
Figure 7:
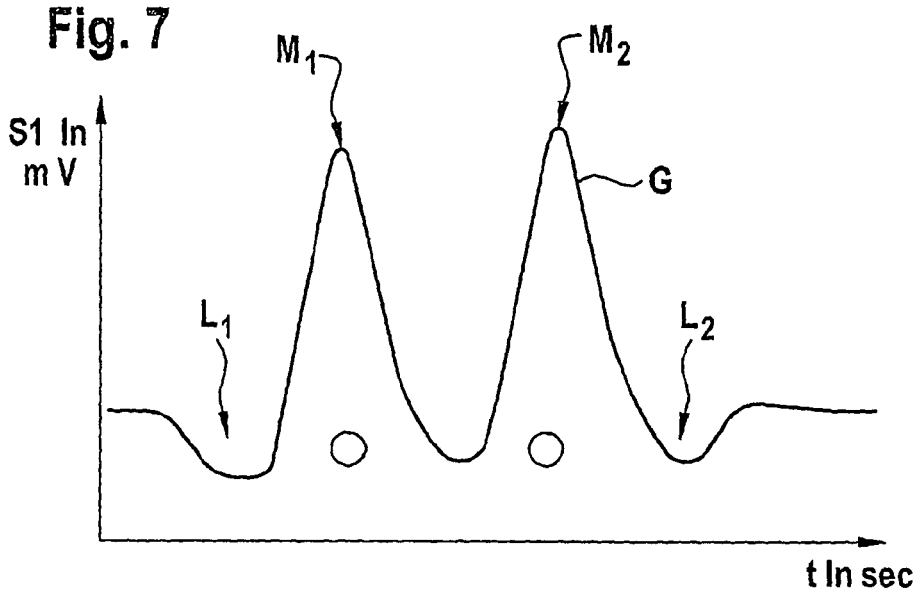
Figure 8:
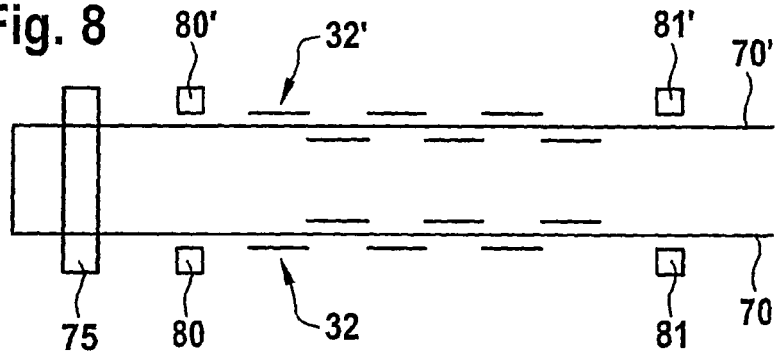
Figure 8:
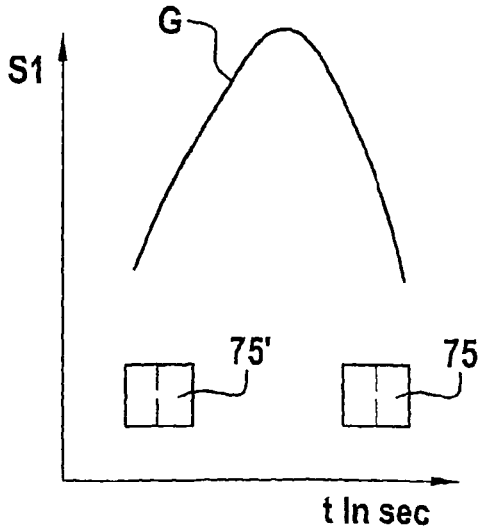
Figure 8:
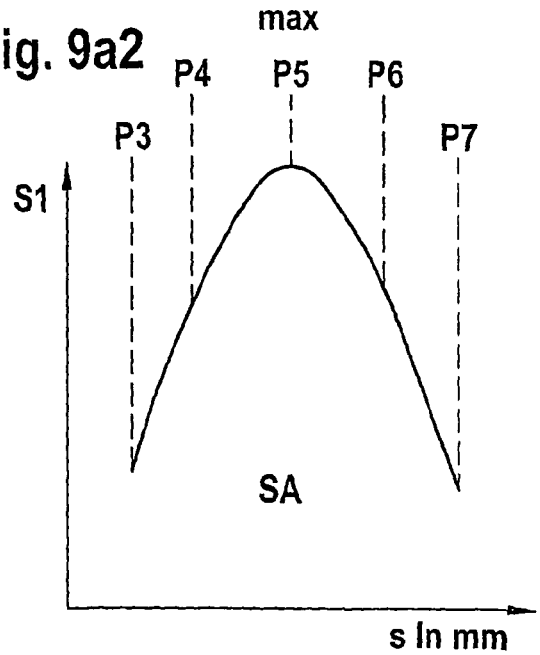
Figure 9D:
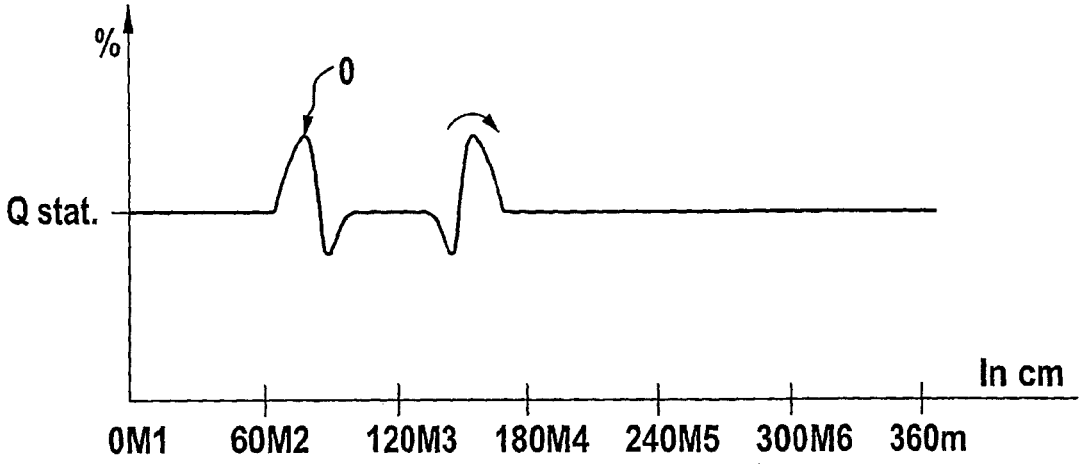
Figure 9D:
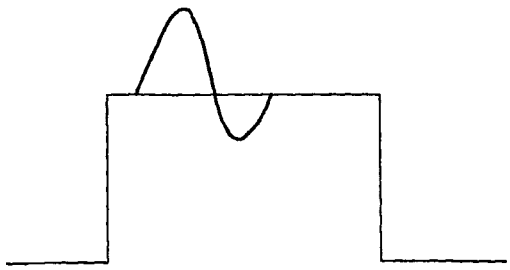
Figure 9D:
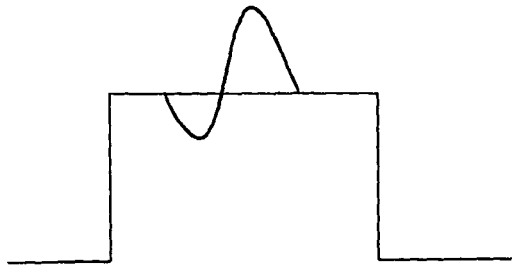
Figure 9D:
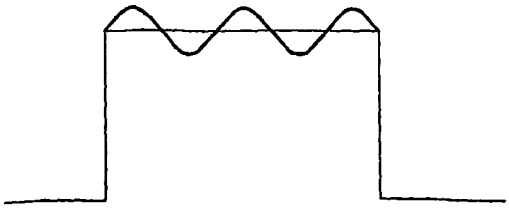
Figure 9D:
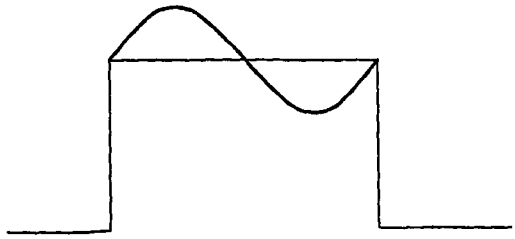

FIG. 2 a schematic representation of a cross section of the rail with a receptacle and a holding part;

FIG. 3 a schematic representation of the rail with the receptacle and an assembly device;

FIG. 4*a* a schematic representation of the rail with the transmitter, the receiver and a measuring beam;

FIG. 4*b* a schematic representation of the transmitter and of the receiver with a neutral measuring beam;

FIG. 4*c* a schematic representation of the transmitter and of the receiver with a deflected measuring beam;

FIG. 4*d* a schematic representation of the transmitter and of the receiver in a side view with a deflected measuring beam;

FIG. 5 the receiver with a current tap and part of the evaluation unit;

FIG. 6 a schematic representation of the rail in a cross section with receivers arranged opposite and with a deflected measuring beam;

FIG. 7 a measuring graph of two wheels depicting approaching and leaving;

FIG. 8 a schematic representation of a rail bed with several transmitter-receiver units and two detection switch pairs;

FIG. 9*a*1 a measuring graph of a bending line between two railroad ties over the time t;

FIG. 9*a*2 a measuring graph of a bending line between two railroad ties over the path s;

FIG. 9*b*1 a measuring graph of a bending line between two railroad ties over the path s with a flat section;

FIG. 9*b*2 a correction graph for a bending line between two railroad ties over the path s;

FIG. 9*c*1 a correction graph for several sensing points over the path s;

FIG. 9*c*2 a measuring graph of several sensing points over the path s;

FIG. 9*d* a representation of the relationship between the measuring graph and the correction graph over the path s;

FIG. 9*e*1 a representation of a plotting of the wheel through a load plateau;

FIG. 9*e*2 a representation of a polygon of the wheel through a load diagram;

FIG. 9*e*3 a representation of an out-of-roundness of the wheel through a load diagram;

FIG. 9*e*4 a representation of a flat section of the wheel through a load diagram.

DETAILED DESCRIPTION

FIG. 1*a* shows a side view of a railroad rail 70 with a rail head 71 and a rail foot 72. A load force F of a wheel 73 of a passenger or freight train (not shown here) acts upon the rail 70. Here, the force F is introduced into the rail at the point P. Through the points P1 and P2 or the railroad ties 75, 75', the force F is dissipated in the form of a surface compression into the substrate or into the rail bed, shown in an idealized manner. Due to the load F, a deformation of the rail 70 and of the elastic rail bed occurs which is picked up by means of a transmitter 2 and a receiver 3.

Here, the transmitter 2 or the receiver 3 is provided in a first receptacle 20 or in a second receptacle 30, respectively, that are arranged on the rail foot 72 of the rail 70 by means of a first holding part 21 or by means of a second holding part 31. Here, the first receptacle 20 or the second receptacle 30 will follow the deformation of the rail 70 or the deformation of the rail foot 72 caused by the load F and will thus pick up the deformation cycle. In order to pick up the deformation cycle, no force is transmitted between the transmitter 2 or the first receptacle 20 and the receiver 3 or the second receptacle 30, so that the deformation cycle is determined in a manner that is loss-free or influence-free.

According to FIG. 1*b*, a uniform transmitter-receiver unit 32 is arranged in the area of the rail foot 72. Here, the transmitter-receiver unit 32 can be configured as a resistance strain gauge and/or as a waveguide that is arranged in the longitudinal direction of the rail.

FIG. 1*c* shows two transmitter-receiver units 32, 32' arranged opposite from each other relative to the longitudinal direction of the rail 70. The attachment is once again on the appertaining rail foot 72 or 72'. The appertaining transmitter-receiver unit 32 is provided over the entire length between the railroad tie 75 and the railroad tie 75'.

In FIG. 2, the first receptacle 20 for the transmitter 2 or for the receiver 3 is arranged on the rail foot 72 of the rail 70. For this purpose, the first receptacle 20 has a screwed joint 22 with a first holding part 21. In addition to the screwed joint 22, the first receptacle 20 with the first holding part 21 has a fit 40 consisting of a tongue 42 of the first receptacle 20 and a groove 41 of the first holding part 21. The screwed joint 22 presses the tongue 42 into the groove 41 so that a positive-fit joint is ensured between the first receptacle 20 and the first holding part 21.

The first receptacle 20 is configured so as to be essentially L-shaped and it has a first leg 20.1 and a second leg 20.2. Between the second leg 20.2 and the first holding part 21, the fit 40 is provided with the tongue 42 and the groove 41. The tongue 42 is arranged on the second leg 20.2 of the first receptacle 20 and the groove 41 is arranged on the first holding part 21. Thanks to the fit 40, in addition to the screwed joint 22, a positive-fit joint is ensured between the first receptacle 20 and the first holding part 21.

The connecting element can consist of the holding part that can be placed underneath the rail foot and of a receiving part made up of two legs and arranged thereupon so as to be height-adjustable, whereby at least two screws can be screwed into the one leg, whereby the one screw can be placed against the component or the rail foot, and the other screw part creates a fixed connection between the holding part and the component or the rail, whereby the second leg can be pressed against the holding part by means of at least one screw.

The first leg 20.1 of the first receptacle 20 has a holding element 24 configured as a bore that serves to receive the transmitter 2 or the receiver 3. In order to secure the transmitter 2 or the receiver 3, there is a fastening element that may be configured as a cap screw 25 and/or as a cap nut that is arranged on the front of the transmitter or of the receiver. The screwed joint 22 passes through the first leg 20.1 and engages a thread 21.1 of the first holding part 21.

In addition to the screwed joint 22 and the fit 40, there is a clamping element 23 that is connected to the rail foot 72 by means of a thread 23.1. Consequently, the clamping element 23, which is configured as a screw, braces the first receptacle 20 against the rail foot 72 by means of the first holding part 21. The fit 40 ensures a clear-cut positioning of the second leg 20.2 relative to the first holding part 21. Due to the pretensioning force of the clamping element 23, a bending force is introduced into the second leg 20.2 that leads to a deformation and thus to an adjustment of the holding element 24 for the transmitter 2 and/or the receiver 3.

On the opposite side of the rail 70, the first holding part 21 has a second groove 41' that serves to secure another receptacle (not shown here).

According to FIG. 3, the first receptacle 20 and the first holding part 21 are provided in the area of the rail foot 72. In addition to the first holding part 21, there is a second holding part 31 that serves to receive the second receptacle 30 for the receiver 3. There is an assembly device 51 for assembling the first receptacle 20 or the second receptacle 30. The assembly device 51 has adjustment elements 52, 52' that can be joined to an adjustment surface 50 of the first holding part 21 and to an adjustment surface 50' of the second holding part 31. The adjustment elements 52, 52' are configured so as to be pin-shaped and they engage the adjustment surfaces 50 and 50' that are configured as bores.

According to FIG. 3, the adjustment surface 50 and the adjustment surface 50' are provided on the bottom of the first holding part 21 and of the second holding part 31, respectively. It is also possible to arrange the adjustment surfaces 50, 50' on another side surface of the receptacle 20 and/or of the holding part 21.

The schematic representation according to FIG. 4*a* shows a rail 70 with the two railroad ties 75, 75'as well as a transmitter 2 and a receiver 3. The transmitter 2 and the receiver 3 are arranged on the rail 70 by means of a first receptacle 20 or a second receptacle 30. When the rail is not yet loaded (i.e. F=0), the measuring beam 4 emitted by the transmitter 2 strikes approximately in the middle of the receiver 3 or else on a receiver surface that is not shown here. According to FIG. 4*b*, the measuring beam 4 strikes the place E1 of the receiver 3 that represents the zero point. No measuring signal is generated.

In FIG. 4*c*, a load F1 causes a deformation of the rail 70. As a result, the transmitter 2 and the receiver 3 are rotated in their relative position corresponding to the bending of the rail 70 by an angle ad1 with respect to each other. The measuring beam 4 then strikes the receiver 3 at a place E2 that is at a distance $\Delta S_1$ from the point E1. In this manner, a measuring signal is generated that corresponds to the distance between the point E1 and the point E2 on the receiver 3 or on a receiver surface 3.1.

The distance that is designated as ds1 $\Delta S_1$ in FIG. 4*d* is proportional to the angular change $\Delta\alpha_1$ and thus proportional to the force change df1 between a resting position according to FIG. 4*a* and the load state according to FIG. 4*c*.

FIG. 5 shows the position change of the measuring beam 4 from E1 to E2 on the receiver 3 or its receiver surface 3.1. This position change generates a measuring current 11 or 12 that is transformed into a measuring voltage U1 or U2 by the evaluation unit 60. The angular change $\Delta\alpha_1$ that is proportional to the deformation or to the force application is calculated according to the following formula:

$$\frac{U_1 - U_2}{U_1 + U_2} = \Delta\alpha_1 = \Delta S_1 = \Delta F_1$$

According to FIG. 6, a normal force $F_Q$ on the one hand and a transverse force $F_Y$ is generated by a rolling wheel 73, whereby $F_Y$ runs at a right angle to $F_Q$ as well as at a right angle to the longitudinal axis of the rail 70. In order to detect both transverse forces $F_Q$ and $F_Y$, there is a need for two transmitter-receiver units 32, 32', each having a receiver 3, 3', that are positioned on opposite sides relative to the rail 70. Accordingly, $F_Q$ and $F_Y$ are calculated according to the following formulas:

$$F_Q = \frac{\Delta\alpha_1 + \Delta\alpha_2}{2}$$

$$F_Y = \frac{\Delta\alpha_1 - \Delta\alpha_2}{\Delta\alpha_1 + \Delta\alpha_2}$$

FIG. 7 shows the measuring signal of a double load cycle. Before the sensing point is reached, the wheel load relieves the rail 70 in the area of the sensing point, since the adjacent rail section is being loaded. The measuring signal has a signal drop L1. Once the sensing point is reached, the measuring signal jumps to a first maximum M1 analogously to the load at the sensing point and, after the first wheel has passed, this measuring signal drops again. Subsequently, the measuring signal rises again to a second maximum value M2 when the second wheel passes. After the passage of the second wheel, the signal drops once again to $L_2$, analogously to the situation when the wheel is approaching.

FIG. 8 shows the rail bed depicted schematically from above, with a railroad tie 75 and a pair of rails 70, 70'. Relative to the direction of travel of the train, to the left of the transmitter-receiver unit 32 or 32', there is a digital or analog detection switch 80, 80' followed by six transmitter-receiver units 32 on each side of the rail. The transmitter-receiver units 32 here are arranged alternately on the inside and on the outside of the rail 70. As an alternative, these can be arranged either only on the inside or only on the outside. Subsequently, there is another detection switch 81'. By means of the detection switch 81, 81', the speed of the train, the number and the relative position of the wheels can be determined and the measuring segment can be activated or deactivated.

The measuring graph G shown in FIG. 9*a*1, which was determined between two railroad ties 75, 75' or between the middle of the two railroad ties 75, 75', is divided according to FIG. 9*a*2 into five specific measuring points. The specific measuring points P3 to P7 serve for the further signal processing or correlation with a correction graph according to FIG. 9b2.

FIG. 9b1 shows a measuring graph G with a first relative maximum R1 and a second relative maximum R2. These relative maxima are generated due to a flat section of the wheel and the associated alternating load of the rail. The flat section leads to a brief drop in the load and thus to a relative minimum F of the graph G.

In order to obtain an independent comparison graph or correction graph K, a correction graph K is determined from all graphs showing a good wheel and this graph K is shown in FIG. 9b2. The correction graph K is like an average load cycle of a perfect wheel per sensor and per train passage and thus has neither relative maxima nor relative minima.

FIG. 9c1 shows the series of all correction graphs K1 to K6 of six consecutive sensing points. The sensing points here cover a rail section of about 3.60 meters. This length corresponds to at least one wheel circumference. The measuring segments overlap each other here by 100 mm towards each side, thus ensuring a seamless detection of the load over the entire rail section. FIG. 9c2 shows the normal load graphs N1 to N6 for each sensing point 1 to 6 generated by the wheel load cycles. For each normal load graph N, approximately ⅙ of the wheel circumference is shown here. Accordingly, the first half of the measured wheel has a flat section F that, according to FIG. 9b1, follows a plotted curve G.

FIG. 9d shows the ratio of the normal load graph N to the correction graph K for a wheel circumference as a load plateau, said ratio ensuring a percentage representation of the rail load with reference to the basic load. Here, the normal load graph N according to FIG. 9e is the normalized mean value of all measuring graphs G of a train passage. Irregularities of each wheel or of the measuring graph G are retained here. The normal load graph N and the reciprocal value of the correction graph K are superimposed here as shown in FIG. 9e and they have a shared mirror value S, by means of which the ratio shown in FIG. 9d is determined according to the following formula:

$$Q = \frac{S - N}{\frac{1}{K} - S}$$

According to FIG. 9e specific wheel flaws per wheel rotation can be recognized on the basis of the generated measuring graphs. According to FIG. 9e1, this is a plotting on the wheel that first generates an overload. The graph according to FIG. 9e2 shows relatively high-frequency, symmetrical load changes that point towards polygons. FIG. 9e3 shows a typical signal of an out-of-roundness of the wheel that leads to a symmetrical graph of a low-frequency type. FIG. 9e4 shows a typical flat section of the wheel that first generates a load drop and subsequently an overload.

What is claimed is:

1. A device for holding a transmitter and a receiver for detecting a deformation state of a component, the device comprising:

a first holding part;

a first receptacle having a first opening for receiving the transmitter, the transmitter being disposed in the first opening, wherein a position of the first receptacle relative to the first holding part is fixed by a first fit joining the first receptacle to the first holding part, wherein the first receptacle and the first holding part, together with the component, form at least one of a first connecting element, a first clamp, a first positive fit joint, a first glued joint, and a first welded joint;

a second holding part; and a second receptacle having a second opening for receiving the receiver, the receiver being disposed in the second opening, wherein a position of the second receptacle is fixed relative to the second holding part by a second fit joining the second receptacle to the second holding part, wherein the second receptacle and the second holding part, together with the component, form at least one of a second connecting element, a second clamp, a second positive fit joint, a second glued joint, and a second welded joint.

2. The device as recited in claim 1, wherein the component is a railroad rail having a foot, wherein the first holding part, the first receptacle, the second holding part and the second receptacle form a deformation sensor, and wherein the deformation sensor is disposed on the railroad rail-directly on the foot in a longitudinal direction of the railroad rail.

3. The device as recited in claim 1, wherein the first fit includes a portion of the first receptacle and a portion of the first holding part and the second fit includes a portion of the second holding part and the second receptacle.

4. The device as recited in claim 1, wherein each of the first and second fits are configured as at least one of a groove-and-tongue joint and a location pin.

5. The device as recited in claim 1, further comprising at least one of a pin joint and a bolted joint, and wherein each of the first and second receptacles includes a lug and is connected to a respective one of the first and second holding parts using the at least one of the pin joint and the bolted joint.

6. The device as recited in claim 1, wherein at least one of the first receptacle and the first holding part includes a clamping element in operative connection with the component.

7. The device as recited in claim 6, wherein the clamping element includes at least one of a bolt, a screw and a cam.

8. The device as recited in claim 1, wherein at least one of the first and second openings includes a bore and a fastening element including a cap screw in operative connection with the bore.

9. The device as recited in claim 1, further comprising an assembly device and wherein the first receptacle and the second receptacle each have at least one corresponding adjustment surface joined to one another using the assembly device.

10. The device as recited in claim 9, wherein the adjustment surface is configured as one of a groove, a bore and a bevel, and wherein the assembly device includes adjustment elements, each corresponding to one of the adjustment surfaces.

11. The device as recited in claim 1, further comprising an evaluation unit, in the measuring area and is in operative connection with the receiver.

12. The device as recited in claim 11, further comprising a further transmitter in operative connection with a further receiver, the further transmitter and further receiver being disposed on an opposite side of the component from the receiver and the transmitter.

13. A method for measuring the deformation of a component using the device of claim 12, the method comprising:

generating a first and second measuring currents by the receiver;

transforming the first and second measuring currents into respective first and second measuring voltages inside the evaluation unit in operative connection with the receiver;

determining an angular change $\Delta\alpha_1$ between the transmitter and the receiver according to the following formula:

$$\frac{U_1 - U_2}{U_1 + U_2} = \Delta\alpha_1$$

determining a load force $F_Q$ in a vertical direction and a load force $F_y$ in a direction perpendicular to the vertical direction, the deformation state of the component being based on the load forces $F_Q$ and $F_y$, the determining of the load forces being performed based on the following formulae:

$$F_Q = \frac{\Delta\alpha_1 + \Delta\alpha_2}{2}$$

$$F_Y = \frac{\Delta\alpha_1 - \Delta\alpha_2}{\Delta\alpha_1 + \Delta\alpha_2}$$

wherein $\Delta\alpha_1$ is the angular change between the transmitter and the receiver, $\Delta\alpha_2$ is the angular change between the further transmitter and the further receiver, $U_1$ is the first measuring voltage and $U_2$ is the second measuring voltage.

14. The method as recited in claim 13, further comprising:

detecting a deformation $\Delta X$ of the component as a function of a length L of the component, the deformation $\Delta X$ being proportional to the detected angular change $\Delta\alpha$;

determining a mean value formation $\Delta X'$ from a plurality of deformation graphs of a load cycle;

normalizing a deformation graph "X over L" using the mean value formation $\Delta X'$; and calculating a ratio of the deformation $\Delta X$ to the normalized deformation $\Delta X'$.

15. The device as recited in claim 1, wherein the component is a rail, the first and second holding parts are disposed underneath a foot of the rail, and the first and second receptacles are disposed on the first and second holding parts in a height-adjustable manner, wherein each of the first and second connecting elements is formed by a respective one of the first and second holding parts and by a respective one of the first and second receptacles, and wherein each of the first and second receptacles includes a first leg, a second leg, and a first screw and a second screw passing through the first leg, the first screw being disposed against the foot and the second screw providing a fixed connection between the holding part and the rail and pressing the second leg against the holding part.

* * * * *